US012420168B2

(12) United States Patent
Smith

(10) Patent No.: US 12,420,168 B2
(45) Date of Patent: Sep. 23, 2025

(54) LEAN-TO-STEER DEVICES WITH ACTIVE STEERING RESPONSES

(71) Applicant: Corey C. Smith, Campton, NH (US)

(72) Inventor: Corey C. Smith, Campton, NH (US)

( * ) Notice: Subject to any disclaimer, the term of this patent is extended or adjusted under 35 U.S.C. 154(b) by 120 days.

(21) Appl. No.: 18/261,602

(22) PCT Filed: Jan. 18, 2021

(86) PCT No.: PCT/US2021/013832
§ 371 (c)(1),
(2) Date: Jul. 14, 2023

(87) PCT Pub. No.: WO2022/154809
PCT Pub. Date: Jul. 21, 2022

(65) Prior Publication Data
US 2024/0173612 A1 May 30, 2024

(51) Int. Cl.
*A63C 17/01* (2006.01)
*A63C 17/12* (2006.01)
*A63C 17/26* (2006.01)

(52) U.S. Cl.
CPC ..... *A63C 17/012* (2013.01); *A63C 17/015* (2013.01); *A63C 17/12* (2013.01); *A63C 17/26* (2013.01); *A63C 2203/12* (2013.01); *A63C 2203/18* (2013.01); *A63C 2203/24* (2013.01); *A63C 2203/52* (2013.01)

(58) Field of Classification Search
CPC ..... A63C 17/012; A63C 17/015; A63C 17/12; A63C 17/26; A63C 2203/12; A63C 2203/18; A63C 2203/24; A63C 2203/52
See application file for complete search history.

(56) References Cited

U.S. PATENT DOCUMENTS

| | | | |
|---|---|---|---|
| 2,802,300 | A | 8/1957 | Rogers |
| 3,511,454 | A | 5/1970 | Hamilton |
| 3,787,066 | A | 1/1974 | Hautler |
| 4,072,325 | A | 2/1978 | Bright et al. |
| 4,712,806 | A | 12/1987 | Patrin |
| 4,740,001 | A | 4/1988 | Torleumke |
| 5,960,900 | A | 10/1999 | Cheng |
| 7,293,622 | B1 | 11/2007 | Spital |
| 8,240,686 | B2 | 8/2012 | Choi |
| 8,251,390 | B2 | 8/2012 | Reichstetter et al. |
| 8,322,477 | B2 | 12/2012 | Kamen et al. |

(Continued)

FOREIGN PATENT DOCUMENTS

| | | | |
|---|---|---|---|
| DE | 4207880 | A1 | 9/1993 |
| JP | 2014-69674 | A | 4/2014 |
| JP | 2014-69675 | A | 4/2014 |

OTHER PUBLICATIONS

Lange, Adam, "E-skateboard with torque vector steering", May 15, 2020, downloaded Mar. 24, 2021 from URL: https://hackaday.io/project/171655-e-skateboard-with-torque-vector-steering.

*Primary Examiner* — Brian L Swenson
(74) *Attorney, Agent, or Firm* — Jeffrey E. Semprebon; Semprebon Patent Services

(57) ABSTRACT

Steering responses for a lean-to-steer device can be provided by controlling the steering angle of at least one wheel by a steering actuator that is operated by a controller. The controller receives signals that are indicative to the current operating conditions and adjusts the steering angle for at least one wheel responsive to the signals.

22 Claims, 5 Drawing Sheets

(56) References Cited

U.S. PATENT DOCUMENTS

| | | | | |
|---|---|---|---|---|
| 9,216,763 | B2 | 12/2015 | Huntzinger | |
| 9,393,483 | B2 | 7/2016 | Tan et al. | |
| 9,526,977 | B2 | 12/2016 | Edney | |
| 9,616,318 | B2 | 4/2017 | Rogers | |
| 9,682,732 | B2 | 6/2017 | Strack | |
| 9,688,340 | B1 | 6/2017 | Kroyman | |
| 9,821,620 | B2 | 11/2017 | Saeger et al. | |
| 11,883,735 | B1 * | 1/2024 | Xeneli | A63C 17/015 |
| 12,077,245 | B2 * | 9/2024 | Jones | B62M 9/06 |
| 2004/0041360 | A1 | 3/2004 | Lukoszek | |
| 2006/0063137 | A1 | 3/2006 | Robbins | |
| 2006/0125200 | A1 | 6/2006 | Cole | |
| 2010/0230924 | A1 | 9/2010 | Kraus | |
| 2012/0119453 | A1 * | 5/2012 | Mercier | B62D 9/02 280/5.51 |
| 2013/0175777 | A1 | 7/2013 | Bermal | |
| 2014/0027192 | A1 | 1/2014 | King | |
| 2016/0158635 | A1 | 6/2016 | Aders | |
| 2016/0206949 | A1 | 7/2016 | Murphy | |
| 2017/0252637 | A1 | 9/2017 | Smith | |
| 2017/0297454 | A1 | 10/2017 | Pang | |
| 2018/0072367 | A1 | 3/2018 | Li | |
| 2018/0185738 | A1 | 7/2018 | Strand | |
| 2018/0214766 | A1 | 8/2018 | Ying | |
| 2018/0272891 | A1 | 9/2018 | Cerboneschi | |
| 2020/0114966 | A1 | 4/2020 | Doerksen | |
| 2020/0122017 | A1 * | 4/2020 | Paris | A63C 17/012 |
| 2020/0238159 | A1 | 7/2020 | Choi et al. | |
| 2020/0254327 | A1 | 8/2020 | Doerksen et al. | |
| 2021/0171132 | A1 * | 6/2021 | Underwood | B62D 51/02 |

* cited by examiner

LEAN-TO-STEER DEVICES WITH ACTIVE STEERING RESPONSES

TECHNICAL FIELD

The present application relates to wheeled devices that steer in response to an operator leaning the device, such as skateboards.

BACKGROUND

Lean-to-steer devices, such as skateboards, are directed by the operator shifting their weight to lean a body of the device, which results in a steering response from one or more wheels. Classis skateboard provide a simple proportional response, where increased tilting results in a proportional increase in steering action, such that the skateboard travels in a curve with a turn radius that becomes smaller the more the body is tilted, Applicant has developed lean-to-steer devices that employ mechanical structures to provide a greater variety of steering responses than can be achieved in a conventional skateboard, as described in PCT/US2016/042877 and U.S. Publication 2017/0252637, both incorporated herein by reference in those jurisdictions where such incorporation is appropriate.

SUMMARY

A lean-to-steer device can be stabilized by adjusting the steering angle of the wheels under the operation of a controller, responsive to sensor signals that indicate the current operating conditions of the device. A typical device has a body with an upper support surface for supporting an operator, the body having a longitudinal axis and a transverse axis. Such a device also has at least one first wheel that is rotatable about a first wheel axis and attached to the body by a first wheel mounting structure that allows the body to tilt about the longitudinal axis relative to the first wheel, the first wheel mounting structure being configured to also allow the first wheel to pivot with respect to a first steering axis to alter the inclination of the first wheel axis relative to the longitudinal axis, and has a steering actuator that is operable to adjust the angular position of the first wheel about the first steering axis. The device has at least a second wheel mounted with respect to the body so as to rotate about a second wheel axis that is displaced from the first wheel axis along the longitudinal axis. A controller is provided, that receives signals responsive to the current operating conditions of the device from at least one sensor (which may include sensors mounted to the device and/or sensors separate from the device, such as a sensor worn or carried by an operator) and which directs the steering actuator to adjust the angular position of the first wheel about the first steering axis in response to the at least one sensor signal. A drive motor could be provided that is operably coupled to drive at least one of the first wheel and the second wheel to propel the device.

The controller may operate, in one mode of operation, to adjust the angular position of the first wheel about the first steering axis to balance forces in the direction parallel to the lateral axis. For example, in such mode of operation, the controller may adjust the angular position of the first wheel about the first steering axis to generate an apparent centrifugal force where the component of force in the direction parallel to the lateral axis is between 25% to 175% of the component of gravitational force in the direction parallel to the lateral axis that results from the operator leaning the body. In other modes of operation, the resulting axial component of apparent centrifugal force may be within 50% to 150%, within 75% to 125%, or within 90% to 110% on the magnitude of the axial component of gravitational force; components of force directed parallel to the longitudinal axis may or may not be ignored. The controller may operate, in one mode of operation, to adjust the angular position of the first wheel about the first steering axis to cause the net lateral forces due to the mass of the operator to form a vector that intersects the support surface of the body; components of force directed parallel to the longitudinal axis may or may not be ignored. The controller may operate, in one mode of operation, to adjust the angular position of the first wheel about the first steering axis to cause; components of force directed parallel to the longitudinal axis may or may not be ignored.

An operator interface may be provided to allow an operator to enter data that is used by the controller to adjust the angular position of the first wheel about the first steering axis in response to the at least one sensor signal. For example, the operator may be able to enter and store operator height data that the controller takes into consideration when adjusting the angular position of the first wheel about the first steering axis (such as to balance forces at a location at or near the operator's center of gravity). As another example, where the controller can provide more than one steering response, the operator may input data that determines the conditions under which the controller selects a particular steering response. The controller may act to provide at least a first response function of adjusting the angular position of the first wheel responsive to the at least one sensor signal and a second response function of adjusting the angular position of the first wheel responsive to the at least one sensor signal, wherein the determination of which response function to implement is made by the controller based on the at least one sensor signal, and wherein the second response function is different from the first response function.

The device may employ more than one first wheel and/or more than one second wheel, and may include means for adjusting the steering angle of the second wheel about a second steering axis that is parallel to and longitudinally spaced apart from the first steering axis, such means for adjusting the steering angle of the second wheel being operated by the controller in response to the at least one sensor signal.

The at least one sensor may include at least one accelerometer that is responsive to forces directed along the transverse axis; in some cases, two or more accelerometers mounted at different heights may be employed. The at least one sensor may include at least one sensor responsive to tilt of the body with respect to the first wheel axis, and at least one sensor responsive to travel speed of the device. The at least one sensor may include a sensor responsive to change in direction of travel. The at least one sensor may include at least one gyroscope. As noted above, the at least one sensor may include one or more sensors mounted to the device (such as being mounted to the body, one or more of the wheels, or one or more of the wheel mounting structures), and/or may include a sensor detached from the device, such as a sensor carried or worn by the operator.

BRIEF DESCRIPTION OF THE FIGURES

FIG. 11 illustrates the case where a sensor is worn by the operator and located close to their center of gravity. FIG. 12 illustrates the case where two accelerometers, placed at different heights, are employed to extrapolate the forces experienced at the operator's center of gravity.

BEST MODES FOR CARRYING OUT THE INVENTION

Figure 1:
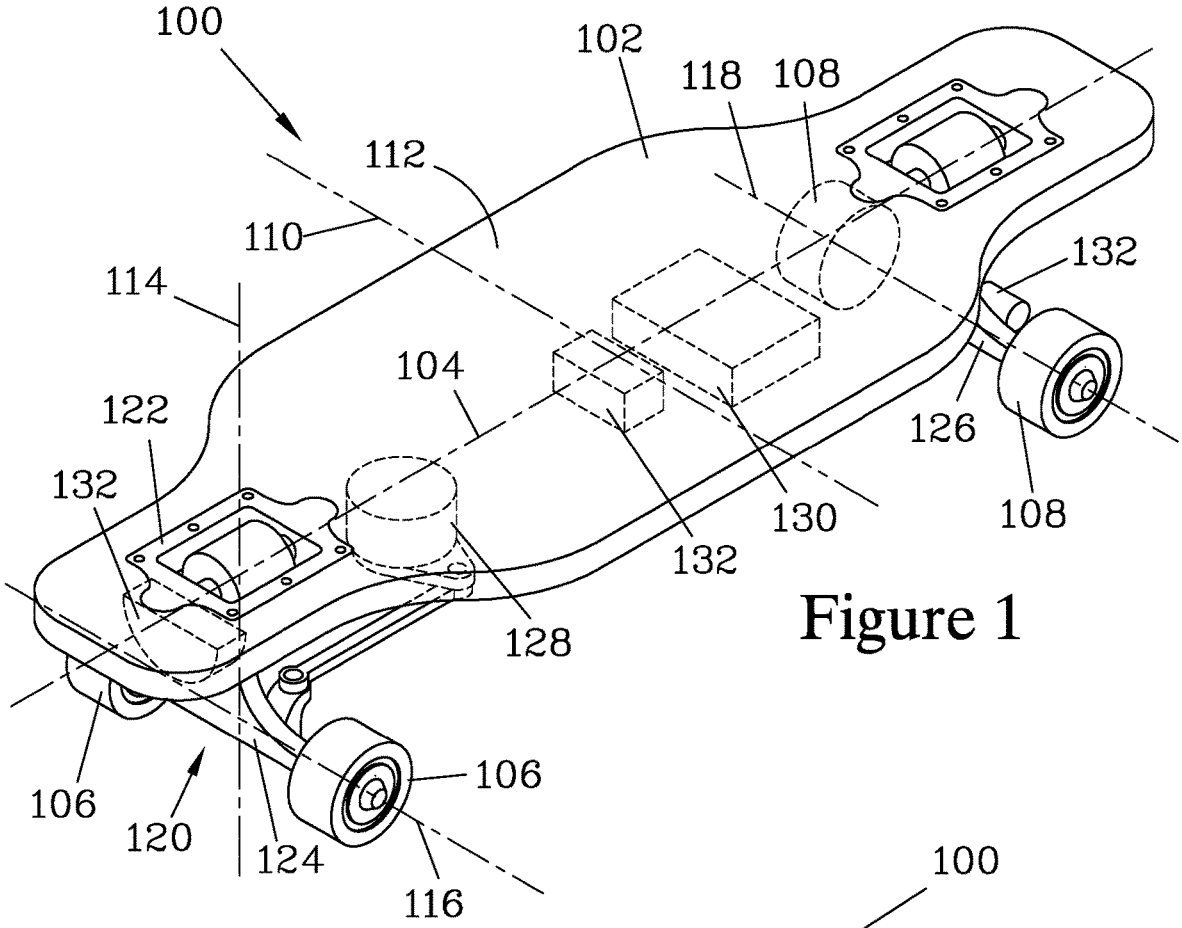
FIG. 1 is an isometric view showing a device having a controller that adjusts the steering angle of a pair of wheels about a vertical steering axis responsive to the operating conditions of the device.
Figure 2:
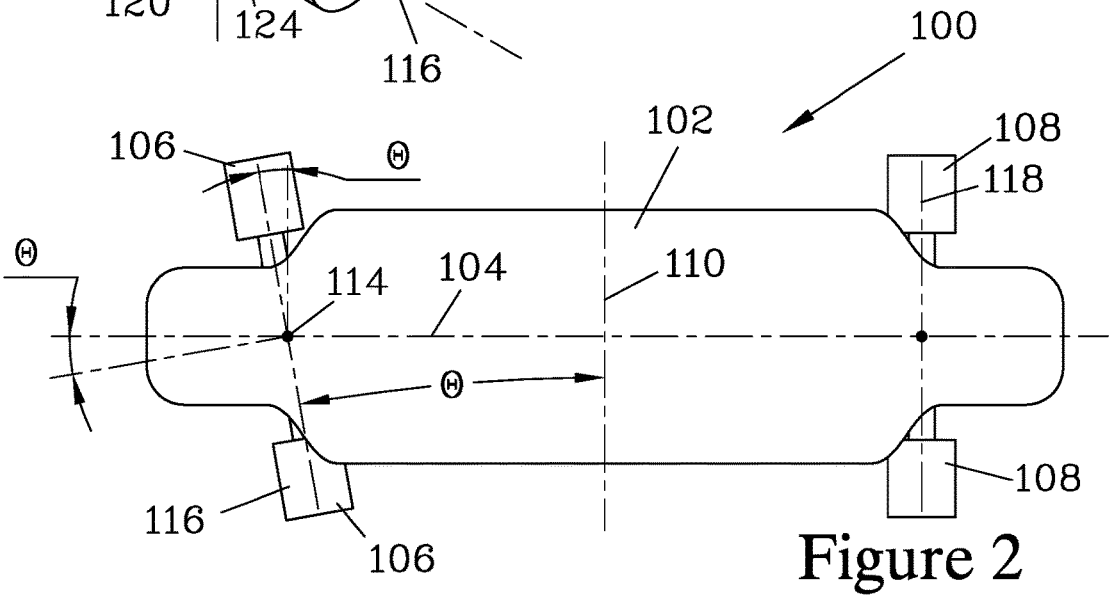
FIG. 2 is a top view of the device shown in FIG. 1, illustrating a steering angle of the front wheels, which can be measured in various ways.

A lean-to-steer device typically has a body with some form of support surface, on which the operator is supported, at least one front wheel, and at least one rear wheel. More than one front wheel can be provided, and more than one rear wheel can be provided; in a typical skateboard-type device, paired wheels are employed, and except where noted, the following description assumes the use of such paired wheels for purposes of illustration. One example of such a device 100 is shown in FIGS. 1 and 2 to illustrate the basic parts and geometry; other configurations could be employed.

The device 100 has a body 102 that defines a longitudinal axis 104, about which the body can tilt ("roll" in aeronautical terminology) relative to a pair of front wheels 106 and a pair of rear wheels 108. The longitudinal axis 104 extends in the direction of travel of the device 100 when it is travelling straight. The body 102 also has a transverse axis 110, which is an axis that is normal to the longitudinal axis 104 and which extends horizontally when the device 100 is at rest on a horizontal surface and no weight is applied to the body 102, such that the body 102 is at a neutral central position with regard to tilting about the longitudinal axis 104 (which can be defined as 0° of tilt). The body 102 in the example shown is formed as a substantially planar board, having an upper support surface 112 on which the operator of the device can stand or sit. Various supports could be employed, either attached to or formed integrally with the body.

The front wheels 106 are steerable about a steering axis 114 which is an axis that intersects the longitudinal axis 104 and which is vertical when the device 100 is at rest on a horizontal surface and the body is at 0° of tilt. The front wheels 106 of this example rotate about a common front wheel axis 116 that is horizontal when the device 100 is on a horizontal surface. As better shown in FIG. 2, the front wheels 106 can be adjusted in angular position about the steering axis 114 by a steering angle Θ, which can be defined in various ways; one convenient measure is the angle of inclination away from a position where a vertical projection of the front wheel axis 116 is perpendicular to the longitudinal axis 104. Another measure is the inclination of a vertical projection of the front wheel axis 116 with respect to the transverse axis 110. One convention is to consider the steering angle Θ to be 0° when the front wheels 106 are positioned to travel straight; the definition and conventions of measurement of the steering angle Θ are arbitrary, and the selections discussed herein are merely adopted for purposes of illustration. Adjusting the steering angle Θ away from the central 0° position, as shown in FIG. 2, results in curved path of travel of the device 100, with the degree of the steering angle Θ defining the turn radius that results.

The rear wheels 108 rotate about a common rear wheel axis 118, which is spaced from the front wheel axis 116 along the longitudinal axis 104. The rear wheels 108 may be steerable about a second steering axis, parallel to the steering axis 114. Alternatively, the rear wheels could be steerable while the front wheels are not; the definition of which wheels are "front" and which are "rear" is a matter of the intended direction of travel, and some devices may not have clearly defined "front" and "rear" ends; thus, while the invention is described in terms of the front wheel(s) being steered, the choice of which wheels are steered will depend on details of the device and the desired steering response. Either the front wheels or the rear wheels which are steered can be considered as "first wheels" that rotate about a "first wheel axis" and are mounted to the body by a "first wheel mounting structure" so as to be adjustable about a "first steering axis"; the other wheels can then be considered as "second wheels" that rotate about a "second wheel axis" and are mounted to the body by a "second wheel mounting structure" and may or may not be adjustable about a "second steering axis". When both the front and rear wheels are steerable, the steering response of the rear wheels may be opposite to that of the front wheels, so as to better conform to a desired curve radius of travel. Steering of the front and rear wheels could be accomplished by separate steering actuators, operated in coordination by the controller, or by a single actuator that steers both the front and rear wheels via an appropriate linkage. For purposes of discussion, the steering action herein is discussed only in terms of the front wheels 106, as discussed in further detail below.

The front wheels 106 are mounted to the body 102 by a front wheel mounting structure 120, having a front mount base portion 122, affixed to the body 102, and front mount wheel portion 124, to which the front wheels 106 are rotatably mounted. The front mount wheel portion 124 is connected to the front mount base portion in such a manner as to allow the front mount wheel portion 124 to tilt with respect to the front mount body portion 122 about the longitudinal axis 104, and to pivot about the steering axis 114. It should be noted that the actual pivot axis about which the front wheels 106 are adjusted may be slightly inclined with respect to the steering axis 114; however, such pivoting will result in pivoting with respect to the steering axis 114. Examples of structures that can provide pivoting about two axes include, but are not limited, to universal joints and ball-and-socket joints. The front wheel mounting structure 120 could be provided by modifying a mechanical lean-to-steer structure such as taught in Applicant's U.S. Publication 2017/0252637, incorporated herein by reference in those jurisdictions where such incorporation is appropriate, by leaving out those interlocking elements that constrain the motion in order to provide the mechanical steering response.

The rear wheels 108 are mounted to the body 102 by a rear wheel mounting structure 126, which in this example is constructed to allow the rear wheels 108 to tilt with respect to the body 102 about the longitudinal axis 104. Such tilting may not always be needed, such as if a single rear wheel with a rounded wheel profile were employed. When the rear wheels are to be steered, the rear wheel mounting structure can provide a range of pivoting motion similar to that of the front wheel mounting structure 120.

The device 100 has a front steering actuator 128 that can operate to adjust the position of the front mount wheel portion 122 relative to the front mount base portion 122, to adjust the steering angle Θ. The front steering actuator 128 is operated by a controller 130, which operates the front steering actuator 128 in response to signals received from one or more sensors 132. The sensor(s) 132 provide the controller 130 with signals that characterize the current operating conditions of the device, and may provide signals responsive to lateral acceleration, tilt, steering angle, curvature of travel, etc. While the device 100 employs sensors 132 incorporated into the device 100, external sensors could be employed, and may be beneficial in some cases, as discussed below with regard to FIGS. 11 and 12. Because the steering response of the lean-to-steer device 100 can be controlled by the steering angle independently of the leaning action of the device, the device 100 can provide much greater flexibility in steering response than is currently available in devices that employ mechanical means to provide a steering response to leaning. Examples of such adjustment of the steering are discussed in greater detail below.

In one example of steering response, the wheels are steered to adjust the turn radius such that the resulting net forces normal to the longitudinal axis form a force vector directed down into the support surface. In such a response, sensors provide signals resulting from current operating conditions to the controller, which in turn directs the response of the steering actuator(s) that turns the wheel(s) to direct the device in the desired direction to produce a change in apparent centrifugal force (which is dependent on speed and turn radius) to offset any force deviation from perpendicular to the transverse axis resulting from lean, gravity, and speed (including any change in speed).

FIGS. 3-6 illustrate a lean-to-steer device 200 in various operating conditions, and illustrate one example of a steering response; in this case, the steering response is discussed in terms of the weight vectors of the operator. The device 200 has a body 202, defining a longitudinal axis 204 and a transverse axis 206, and having a support surface 208. A pair of front wheels 210 rotate about a common front wheel axis 212, and a pair of rear wheels 214 rotate about a rear wheel axis 216. The front wheels 210 can be adjusted about a steering axis 218. The device also has a steering actuator, a controller, and at least one sensor; these elements are omitted for clarity.

Figure 3:
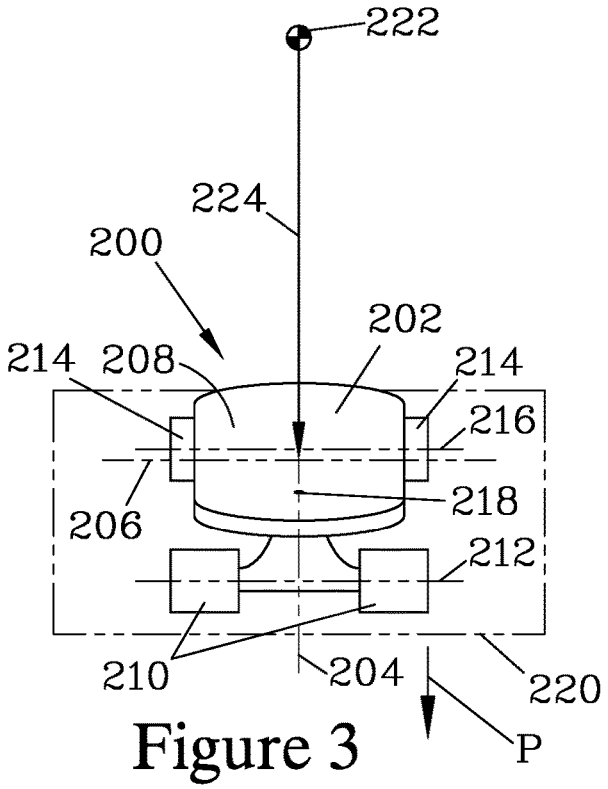
FIGS. 3-6 are front, slightly elevated views of a lean-to-steer device in various operating conditions, showing the force vectors due to the weight of the operator and, when traveling on a curved path, apparent centrifugal force.

FIG. 3 shows the device 200 where the device is traveling across a horizontal surface 220. If the operator does not lean the device (roll angle of the body 202 about the longitudinal axis 204 remains 0°), the steering angle remains at 0°, and the device 200 travels along a straight path of travel, as indicated by the arrow P. In such case, the weight of the operator due to gravity is directed straight downward from the center of gravity 222, and the resulting weight vector 224 is perpendicular to the transverse axis 206, and is directed to intersect the longitudinal axis 204

Figure 4:
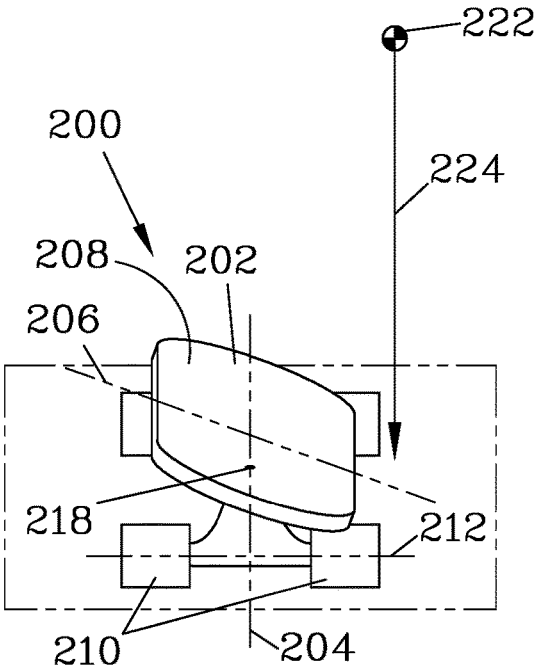
Figure 5:
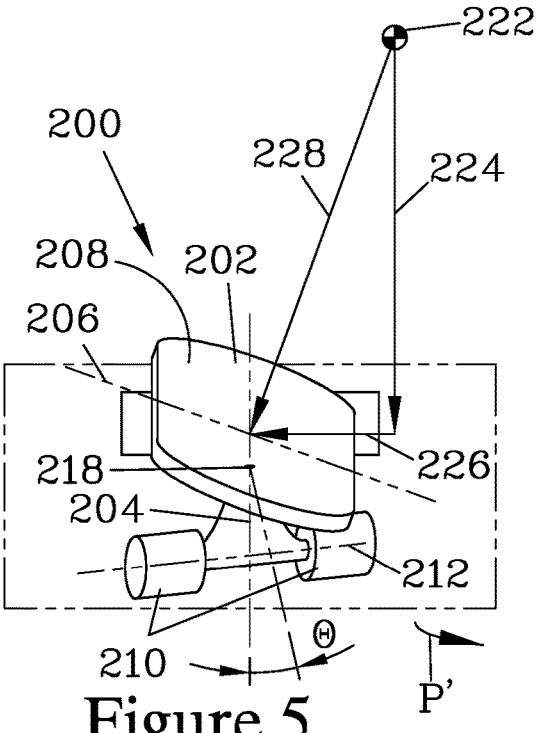

When the operator leans the device 200 as shown in FIG. 4 (rolling the body 202 away from its center position), the weight of the operator becomes off-center, and the weight vector 224 is displaced away from a center position, creating a potentially unstable condition. When the sensor(s) provide signals to the controller that detect such condition, the controller can operate the steering actuator to adjust the steering angle to steer the device 200 into a curve in the direction of the lean, such that the device 200 now follows a curved path of travel, as indicated by the arrow P'. The resulting steering angle Θ sets a turn radius of the curved path, and creates an apparent centrifugal force that is dependent on the radius of curvature and the speed. This apparent centrifugal force counteracts the off-balance weight, as represented by force vector 226, with the net force (with respect to the side-to-side direction of the body 202) being a combined vector 228 that is again centered with respect to the transverse axis 206. The actual vector could be off center in the fore-and-aft direction (i.e., intersecting at different points on the longitudinal axis 204), but such fore-and-aft components of force can typically be ignored. While illustrated as being centered on the body 202, the combined vector could be somewhat inclined, and intersect the support surface 208 at a location displaced from the center. One convention is for the net force vector to be directed such that, if extended sufficiently far, it would intersect the longitudinal axis 204; this can be considered a 0° vector offset. Depending on the desired performance of the device, the resulting vector could be within 300 of a direction that intersects the longitudinal axis, or could be within 20°, within 10°, or within 5° of such direction.

One way to consider the relationship between curvature and speed in such a case is that, at a given speed and radius of curvature of movement across a horizontal surface, there is an associated angle equal to the angle at which a pendulum will make relative to the surface due to the apparent centrifugal force acting on the pendulum, causing it to hang radially outwards from a straight vertical line. Thus, at a particular speed, any degree of tilt of the body is matched to a certain radius of turn, and the steering angle of the wheel(s) can be adjusted to provide the matched radius of curvature, such that the current tilt angle of the body about the longitudinal axis equals the "pendulum angle" for the current speed and radius of turn, such that the weight of the operator is largely directed down onto the support surface, which tilts with the body. Thus, for travel across surfaces that are horizontal or close enough to horizontal, the controller could determine an appropriate steering response using sensors that only monitor tilt and speed. Additional sensors could be employed, such as a gyroscope, accelerometer, or other device to distinguish tilting due to traveling on an inclined surface from tilting to steer the device, by detecting the degree of curvature of the path of travel. While such a response function is useful for wider turn radii, stability on tighter curves may benefit from additional considerations, as discussed below with regard to FIGS. 11 and 12.

In addition to the forces resulting from leaning and turning (which could be considered as lateral forces, as the effective weight of the operator is shifted from side to side relative to the body 202), there may be additional forces that effectively shift the weight of the operator longitudinally, such as traveling on an incline and/or accelerating or decelerating. In many cases, the component(s) of forces directed in a fore-and-aft direction can be ignored, as the operator typically engages the support surface in a manner that accommodates significant fore-and-aft forces, and/or the operator may be able to accommodate such force by shifting their weight, such as shifting weight from one foot to the other. Fore-and-aft forces, such as due to traveling on an inclined surface and/or accelerating or decelerating, can typically be ignored when traveling straight, and treated as lateral components of tilting or curving forces when the steering is adjusted.

Figure 6:
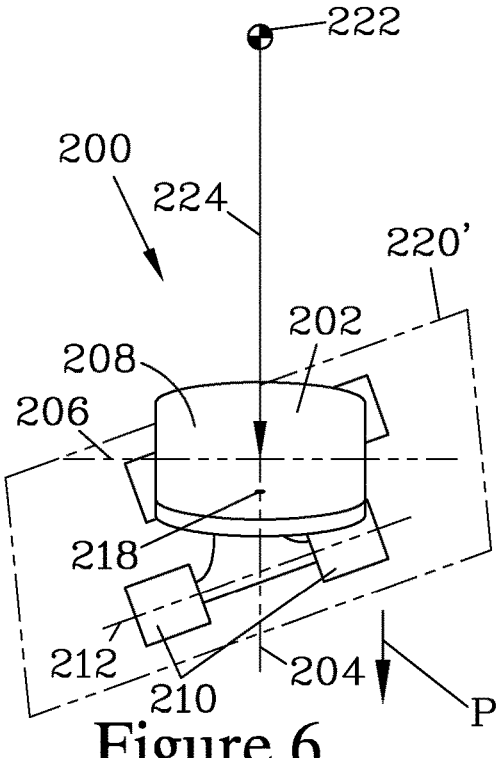

FIG. 6 illustrates a case where the device 200 travels across an inclined surface 220'. In this case, the wheels 210, 214 are tilted with respect to the body 202, such that the wheel axes 212, 214 are inclined to the transverse axis 206 (in fact, the angle of tilt is the same as for FIGS. 4 and 5, but here the surface 220' is inclined, and the tilt serves to keep the support surface 208 level along the transverse axis 206). Since the body 202 is level from left to right (and fore-and-aft components of forces are ignored), the operator's center of gravity 222 again creates a weight vector 224 that is centered with respect to the transverse axis 206. No side-to-side acceleration due to gravitational forces are experienced while the device 200 travels straight, and thus no steering action of the front wheels 210 is made. This is in contrast to action of a conventional device such as a skateboard, where the operator traversing straight across an inclined surface would need to keep the body angled parallel to the ground surface, to avoid causing the wheels to steer away from a neutral center position. By controlling the steering action independently, the operator of the device 200 can keep the body 202 level from left to right, while the front wheels 210 are angled relative to the body 202 to conform to the inclined surface 220'. When a steering action is made by the operator leaning the body 202 about the longitudinal axis 204 relative to horizontal (whether on an inclined or horizontal surface) while in motion, the tilt causes an off-balance force due to the force of gravitation now being directed off center, and controller can then actuate the steering motor(s) to steer the front wheels 210 such that the off-center gravitational force, combined with the apparent centrifugal force resulting from curving motion as the wheels steer (as well as any additional forces, such as due to changing speed), cause the resulting lateral forces vector (formed by ignoring the fore-and-aft components of the forces) to be centered (or roughly centered) on the body 202.

Figure 7:
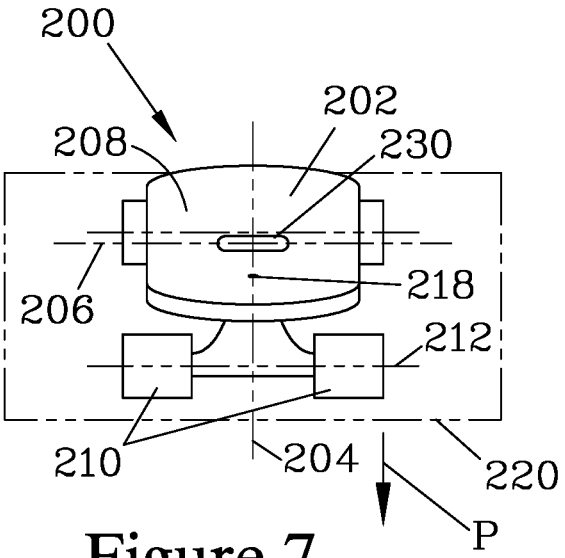
FIGS. 7-10 show the device shown in FIGS. 3-6 in the same operating conditions, but illustrating the forces experienced by an accelerometer that responds to forces directed along a transverse axis of the body of the device.

FIGS. 7-10 illustrate the same lean-to-steer device 200 in the same operating conditions as shown in FIGS. 3-6, illustrating an example of a steering response that is similar to that discussed above, but where the steering adjustment is responsive to lateral accelerations caused by the components of force directed along the transverse axis 206. Thus, the device 200 is here equipped with an accelerometer 230 that serves as a sensor to provide signals to a controller. FIG. 7 shows the device 200 where the device is traveling on the straight path of travel P across the horizontal surface 220. If the operator does not lean the device, no side-to-side forces are created, and the steering angle remains at 0°.

Figure 8:
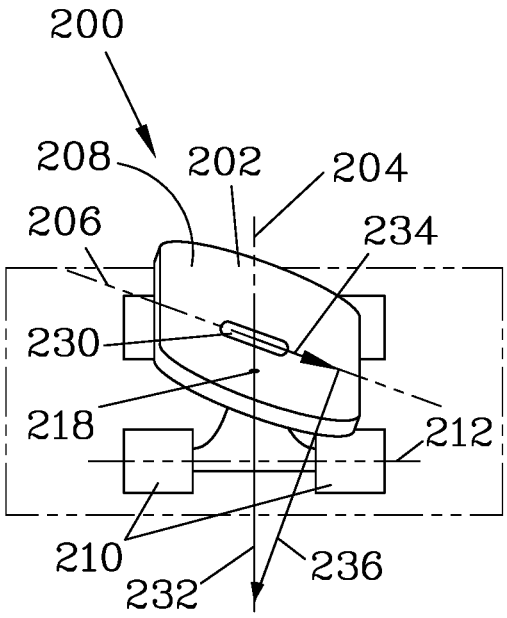
Figure 9:
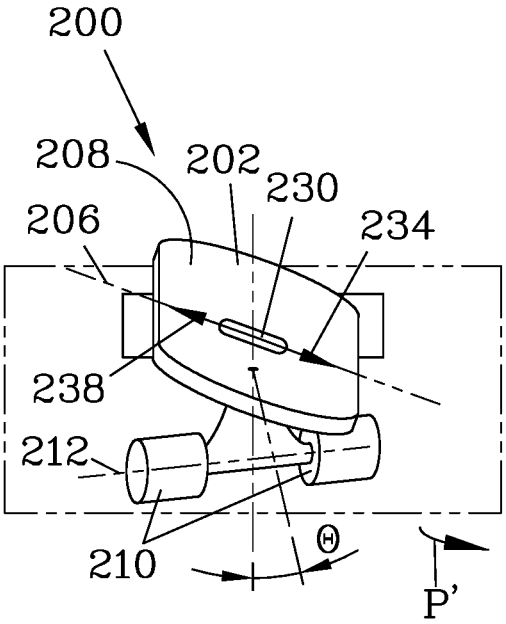
Figure 10:
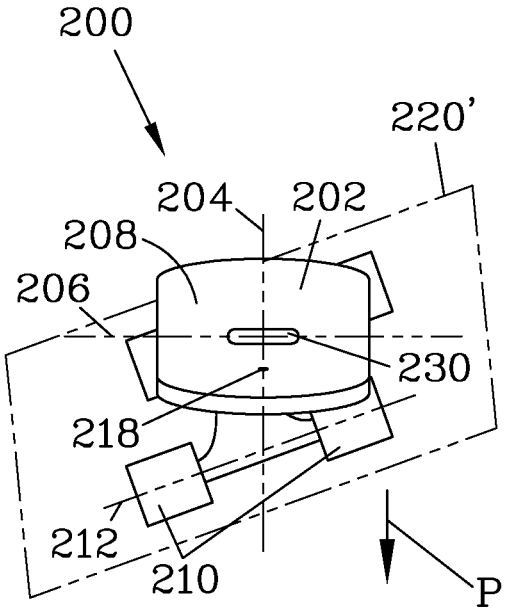

When the operator leans the device 200 as shown in FIG. 8, the accelerometer 230 is tilted, and experiences an off-center force due to gravity pulling on one side. The force due to gravity, represented by vector 232, is directed straight downward, while the accelerometer 230 is tilted. From the frame of reference of the accelerometer 230, the gravity vector 232 can be considered to have an axial component 234 directed along the transverse axis 206, and a normal component 236 that is normal to the transverse axis 206 (and which may be ignored). The accelerometer 230 provides a signal to the controller representing the off-center gravity vector axial component 234. The controller can operate the steering actuator to adjust the steering angle of the front wheels 210 to direct the device 200 into the curved travel path P'. The turn radius of the curved path creates an apparent centrifugal force, indicated by vector 238 (which is the component along the transverse axis 206 of a centrifugal force vector pointing left) that is dependent on the radius of curvature and the speed. The steering angle can be adjusted until the curvature of motion is such that the apparent centrifugal force vector 236 counteracts the gravity axial component 234, resulting in a net lateral force of zero. Reducing the net lateral force to zero by completely balancing the forces is typically not necessary (and may not be desirable in some cases, as discussed below), and the steering adjustment may be made such that the resulting axial apparent centrifugal force vector 238 is within the range from 25% to 175% of the magnitude of the gravity axial component 234. Depending on the desired response, the steering may be adjusted such that the resulting axial apparent centrifugal force vector 238 is within the range from 50% to 150%, the range of 75% to 125%, or the range of 90% to 110% of the magnitude of the gravity axial component 234.

FIG. 10 again illustrates the case where the device 200 travels across an inclined surface 220', with the wheels 210, 214 tilted with respect to the body 202 to keep the accelerometer 230 level along the transverse axis 206. Since the body 202 is level from left to right, the acceleration due to gravity at is centered with respect to the transverse axis 206, and no off-balance accelerations are detected. The accelerometer provides signals to the controller indicating such, and the controller maintains the front wheels 210 at a steering angle Θ of 0°.

Figure 11:
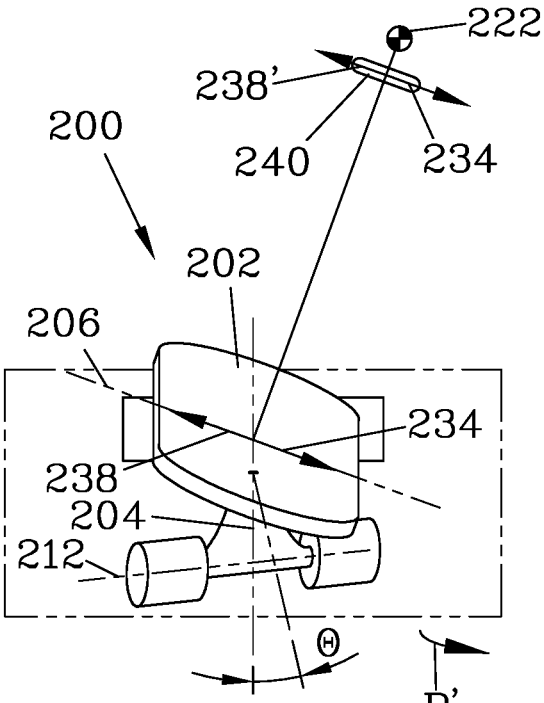
FIGS. 11-12 show the device shown in FIGS. 7-10, but where different sensors are employed to provide a more stable response on tight curves, where the forces experienced by the device do not accurately reflect the forces experienced at the center of gravity of an operator.

When the device 200 is to be employed in relatively tight curves, the forces experienced at the location of the device 200 may not accurately reflect the forces experienced by the operator, since the operator's center of gravity 222 typically resides above the device 200. When the operator leans to direct the device 200 into a curving path, the leaning places the operator's center of gravity 222 at a smaller radius of curvature than that of the device 200. As shown in FIG. 11, this results in a smaller magnitude of the apparent centrifugal force component 238' directed parallel to the transverse axis 206, without changing the gravity axial component 234. While this difference may be negligible in many operating conditions, in very tight curves, balancing the apparent centrifugal force for the larger radius of curvature experienced by the device 200 results in a corrective force that is too small to correct the off-center gravitational force experienced at the center of gravity 222, causing imbalance that tends to push the operator downward.

FIG. 11 illustrates one approach to addressing such a situation, where the operator carries a sensor 240 located close to their center of gravity 222. The sensor 240 includes an accelerometer or combination of accelerometers responsive to lateral forces parallel to the transverse axis. In some cases, the operator may already carry an electronic apparatus such as a smart phone that includes accelerometers, in which case the apparatus can be loaded with a program to use the included accelerometers and transmit the appropriate sensor signals to the controller (note that some of the operations of the controller could be performed by the electronic apparatus itself). The controller can then simply adjust the steering to apply an apparent centrifugal force that counteracts any offset in gravitational force to result in zero net lateral forces at a location near the operator's center of gravity 222.

Figure 12:
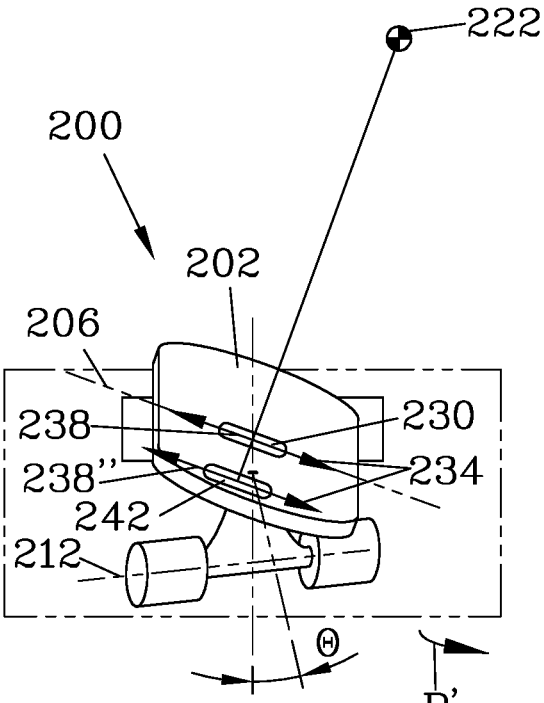

FIG. 12 illustrates another approach to addressing this situation, which does not rely on the operator having a sensor 240 located near their center of gravity 222. In this example, the accelerometer 230 is employed in conjunction with a supplementary accelerometer 242, which is mounted to the body 202 at a different height than the accelerometer 230. When the operator leans the device 200 to turn, the accelerometers 230, 242 are placed at slightly different curve radii, due to the difference in height, resulting in different apparent centrifugal force vectors 238, 238" (note that the difference in magnitude is exaggerated in FIG. 12 for purposes of illustration). Because the accelerometers 230, 242 are subject to different ratios of apparent centrifugal force to gravitational axial force, this difference resulting from the known difference in heights of the accelerometers 230, 242 can be extrapolated to determine the forces experienced at the height of the operator's center of gravity 222. The controller could make such extrapolation based on a standard default height, or could be configured to accept and store the input of height data for the operator to use when making such extrapolation.

Figure 13:
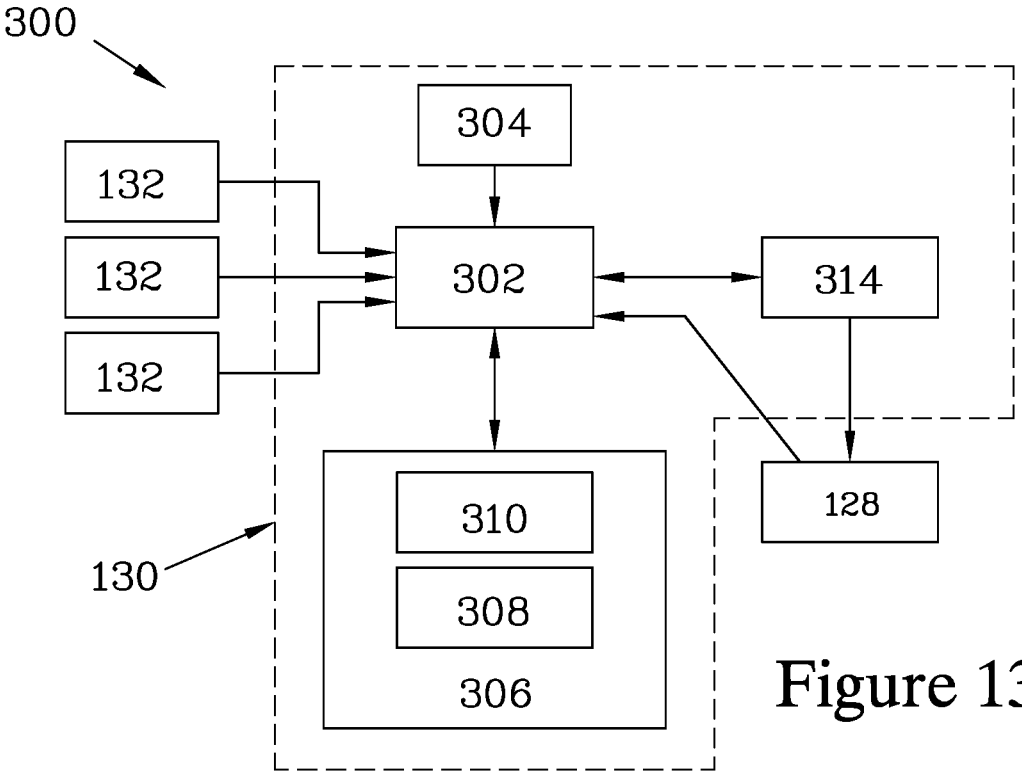
FIGS. 13 and 14 are is a block diagrams showing one example of a control system that can be used in the device shown in FIGS. 1 and 2; the figures differ in the steering routines stored in a memory.
Figure 14:
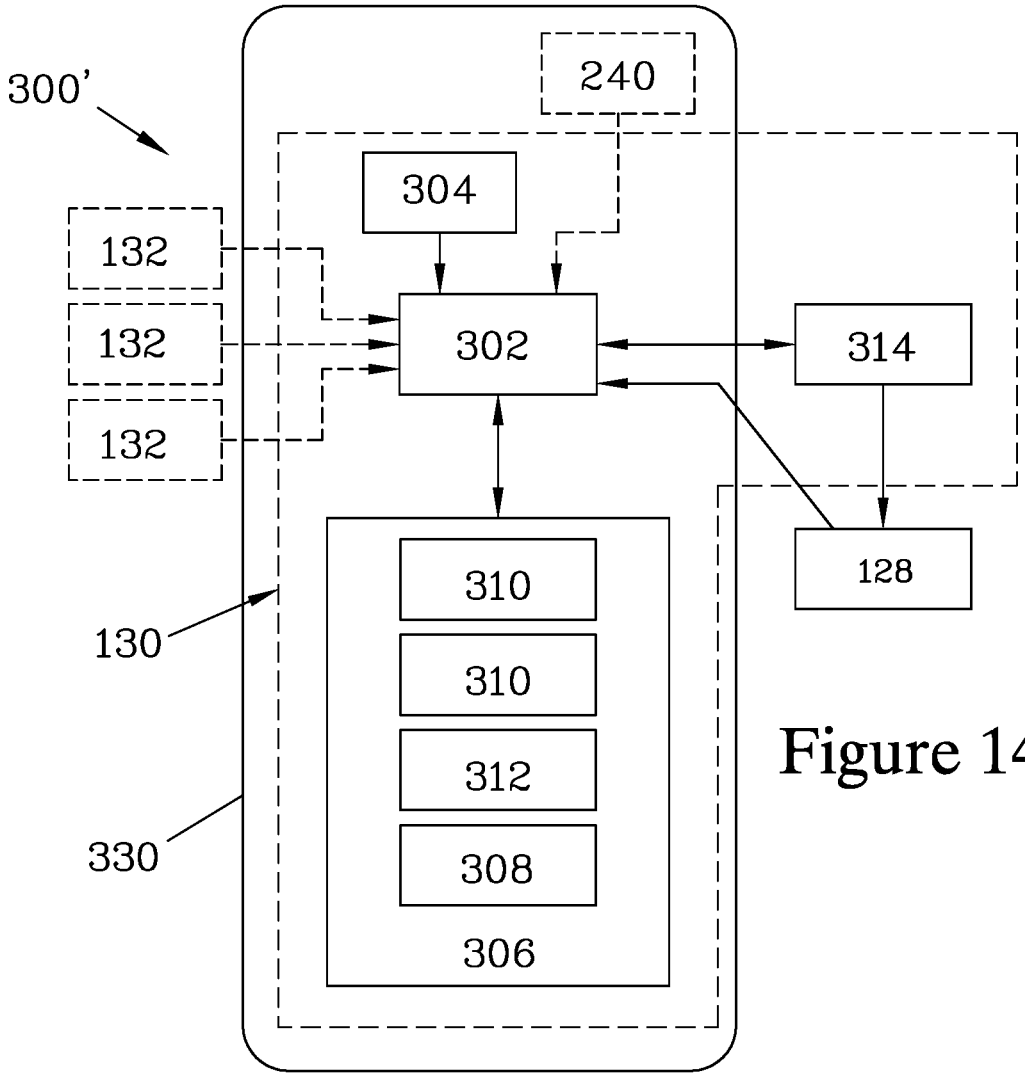

FIGS. 13 and 14 are block diagrams illustrating examples of control systems 300 and 300' for operating the steering of a lean-to-steer device such as the devices 100, 200 discussed above, and is described with respect elements of the device 100. Conventional elements of an electrically-operated device, such as batteries for power, wiring, etc. are well known and are therefore not illustrated. Components of the control system 300 include:

| | |
|---|---|
| Microprocessor | 302 |
| Operator interface | 304 |
| Memory | 306 |
| Stored parameters | 308 |
| Steering routine(s) | 310 |
| Selector routine | 312 |
| Actuator controller | 314 |

The operation of the steering actuator 128 is controlled by the controller 130, which typically includes a microprocessor 302. The controller 130 can be provided with an operator interface 304 that allows an operator to select the desired parameters of the steering response, as well as other data such as registration information of the operator, and the height of the operator. One simple scheme for providing the operator interface 304 is to provide a wireless connection that communicates with a remote electronic device, such as a tablet or smart telephone that communicates with the operator interface 304 through wireless communication and runs a software application allowing the operator to select the desired response parameters. The controller 130 may have an associated memory 306 that may store parameters 308 set by the operator via the operator interface 304, and stores one or more steering routines 310. FIG. 13 illustrates the memory 306 when a default steering routine 310 is stored, while FIG. 14 illustrates the memory 306 when multiple possible steering routines 310 are stored, which can allow a discontinuous steering response, and/or could allow an operator to select a desired steering response. FIG. 14 also shows a selector routine 312, discussed below.

Additional routines that adjust the steering response conditionally could be included in the memory 306, and could be either selectively activated by the operator or set as default routines, such as routines to alter the steering response to provide safer operation of the device 100. For example, where instrumentation is provided to detect steering oscillations at a frequency indicative of high-speed wobble, a routine could be provided to detect such a condition and reduce the steering response to correct the condition. In another example, a routine could be set to provide a delayed change in steering response relative to indicated speed, to compensate for conditions where the operator may manipulate the device such that the wheel rotation speed does not accurately reflect the actual speed of the device over the ground surface. One example of the such condition may exist when an operator turns the device sideways to slow, causing the wheels to slip across the surface momentarily before the operator straightens out the device; a delayed-response routine would avoid having the steering response dramatically change during the interval when the operator turns sideways, causing the wheels to slow or stop briefly before straightening out causes them to rotate again.

Sensors 132 are included in the device 100, and may be mounted to the body 102 or to one of the wheel mounting structures 120, 126. As noted above, remote sensors such as the sensor 240 carried or worn by the operator could be employed, either in replacing or supplementing sensors mounted to the device itself. The steering actuator 128 may also serve as a sensor, providing a signal that indicates the current steering angle Θ; a separate sensor could also be employed, and may be beneficial in detecting a wobble condition. Examples of sensors that could be employed include one or more accelerometers as discussed above, a tilt sensor responsive to the relative tilt between the body 102 and the front wheel axis 116 about the longitudinal axis 104, a speed sensor responsive to the current speed of the device 100 over the ground (such as by monitoring the rotation speed of one or more of the wheels 106, 108), and/or one or more sensors responsive to changes in direction, such as a gyroscope or 3-axis accelerometer. Other sensors that provide signals responsive to conditions to allow for adjusting the steering in response to such conditions could be employed. In the control system 300 illustrated, the sensors 132 provide signals that characterize the current operating conditions of the device 100 to the controller 130. The controller 130 then operates the steering actuator 128 via an actuator controller 314, according to the current steering routine 310, to adjust the angle of the front wheels 106 responsive to signals from the sensors 132 in order to provide the desired steering response.

The control system 300' shown in FIG. 14 also differs from the control system 300 in incorporating some of the features of the controller 130' into a housing 330 that is detached from the device 100. The housing could be provided by an electronic apparatus such as a tablet or smart telephone or could be provided by a dedicated control apparatus, and can optionally including one or more sensors 240. In the example illustrated, the microprocessor 302 is located in the housing 330, and communicates with the actuator controller 314 via wireless communication, such as a Bluetooth connection. It should be appreciated that various functions of the control system can vary in their location with respect to the body 102 of the device 100, and FIGS. 13 and 14 merely illustrate two options.

Figure 15:
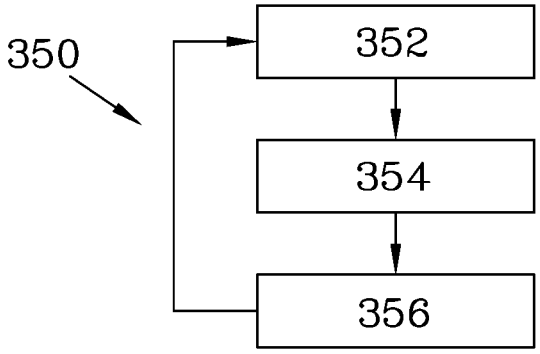
FIGS. 15 and 16 are flow charts showing two examples of a control routine that can be employed.

FIG. 15 shows one example of a steering routine 310, a deterministic routine 350. The steps of the steering routine 350 are:

| | |
|---|---|
| Sense operating conditions | 352 |
| Calculate steering angle | 354 |
| Operate steering actuator | 356 |

The signals from the sensors 132 are received by the controller 130 (in step 352), and are processed (in step 354) to determine an appropriate steering angle Θ to direct the device 100 along a curved path with a turn radius that will act to counter-balance the forces resulting from the operator leaning, as discussed above with regard to FIGS. 3-12. Such determination could include calculations, look-up tables, machine learning routines, and/or similar techniques. The controller 130 then directs the steering actuator 314 (in step 356) to adjust the steering angle Θ to match or closely approach the determined appropriate angle.

Figure 16:
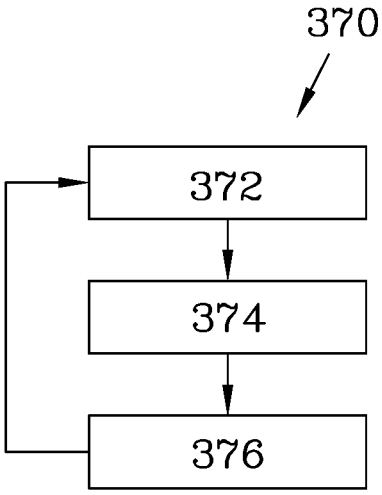

FIG. 16 shows another example of a steering routine 310, a trial-and-error routine 370. The steps of the steering routine 370 are:

| | |
|---|---|
| Sense/store operating conditions | 372 |
| Evaluate change from previous | 374 |
| Operate steering actuator | 376 |

In the routine 370, the signals from the sensors 132 are received by the controller 130 (in step 372), and are also stored in the memory 306. The current operating conditions are compared to the previously-stored operating conditions (in step 374) to evaluate whether the current conditions are better (such as the lateral forces being better balanced) or worse than the previous conditions. The steering actuator 314 is then directed (in step 376) to adjust the steering angle Θ either further in the current direction of adjustment, if the current conditions are better, back from the previous direction of adjustment, if the current conditions are worse, or to maintain the same steering angle if the conditions are the same. The step 374 of evaluating the change may ignore changes below a set threshold and/or include a degree of hysteresis in the steering response to avoid oscillations in the steering angle.

When multiple steering routines 310 are stored in memory (as shown in FIG. 14), the controller 130 can be programmed to provide a discontinuous steering response, where different steering responses are provided under different operating conditions. As one example, a wheeled ski training device (typically having only a single front wheel and single rear wheel) could be designed to simulate the action of snow skis that are designed to carve turns at a particular design radius. One example of a discontinuous response to provide such simulated action is to operate a steering response similar to that of the steering routines 350 or 370 when the sensors indicate that the current conditions of operation are within a prescribed range for one or more parameters (for example, tilting up to a certain degree or adjustment of steering angle up to a certain degree, speed above or below a set value, etc.). The selector routine 312 is responsive to the signals, and when they indicate that the operation parameter(s) falls outside the prescribed range, the switch routine 312 directs the controller to select a different steering routine 310, which provides a different response. In the example of simulating the action of a snow ski, the controller 130 first selects a steering routine in which greater leaning results in increasing the steering angle to balance the off-center gravity force, but at the point where the steering angle reaches a maximum (defining the desired curve radius), the selector routine 312 directs the controller to switch to a different steering routine, in which the steering angle is not adjusted further in response to increased tilting. The switch routine 312 could be responsive to stored data in the memory, such as to allow an operator to select the range value at which the steering response is switched.

The present invention provides benefits for either motor-driven or non-driven lean-to-steer devices. Since power must be provided to operate the steering motor and to power the electronics of the controller and associated equipment, the present invention should be particularly advantageous for use to control the steering action of motorized lean-to-steer devices, in which case the device has a driven wheel. In such situations, some of the elements for sensing and controlling may be integrated with the equipment employed to control the drive speed of the device. Alternatively, in some cases it may be practical to employ the energy of the rotating wheels to generate electrical power to operate the steering control system of the device.

While the novel features of the present lean-to-steer devices have been described in terms of particular examples and operating situations, it should be appreciated that substitution of materials and modification of details can be made without departing from the spirit of the invention. While particular axes and angles of geometry are called out for purposes of explaining the operation, the selection of particular geometry for reference is somewhat arbitrary, and alternative schemes of definition could be employed to provide similar steering responses.

The invention claimed is:

1. A lean to steer device comprising:

a body with an upper support surface for supporting an operator, said body having a longitudinal axis and a transverse axis;

a first wheel rotatable about a first wheel axis;

a first wheel mounting structure that attaches said first wheel to said body while allowing said body to tilt about the longitudinal axis relative to said first wheel, said first wheel mounting structure being configured to allow said first wheel to pivot with respect to a first steering axis to alter the inclination of the first wheel axis relative to the longitudinal axis;

a steering actuator that is operable to adjust the angular position of said first wheel about the first steering axis;

a second wheel mounted with respect to said body so as to rotate about a second wheel axis that is displaced from said first wheel axis along the longitudinal axis; and a controller that receives signals responsive to the current operating conditions of the device from at least one sensor, said controller directing said steering actuator to adjust the angular position of said first wheel about the first steering axis in response to the at least one sensor signal, wherein said controller, in at least one mode of operation, adjusts the angular position of the first wheel about the first steering axis to balance forces in the direction parallel to the lateral transverse axis by directing said steering actuator to adjust the angular position of the first wheel about the first steering axis such that the resulting component of force in the direction parallel to the lateral axis due to apparent centrifugal force is within 25% to 175% of the magnitude of the component of gravitational forces in the direction parallel to the transverse axis.

2. The lean-to-steer device of claim 1 wherein said steering actuator is operable to adjust the angular position of said first wheel about the first steering axis independently of the leaning action of the device.

3. A lean to steer device comprising:

a body with an upper support surface for supporting an operator, said body having a longitudinal axis and a transverse axis;

a first wheel rotatable about a first wheel axis;

a first wheel mounting structure that attaches said first wheel to said body while allowing said body to tilt about the longitudinal axis relative to said first wheel, said first wheel mounting structure being configured to allow said first wheel to pivot with respect to a first steering axis to alter the inclination of the first wheel axis relative to the longitudinal axis;

a steering actuator that is operable to adjust the angular position of said first wheel about the first steering axis;

a second wheel mounted with respect to said body so as to rotate about a second wheel axis that is displaced from said first wheel axis along the longitudinal axis; and a controller that receives signals responsive to the current operating conditions of the device from at least one sensor, said controller directing said steering actuator to adjust the angular position of said first wheel about the first steering axis in response to the at least one sensor signal, wherein said controller, in at least one mode of operation, adjusts the angular position of the first wheel about the first steering axis to cause the net lateral forces due to the mass of the operator to form a vector that intersects the support surface of the body.

4. The lean-to-steer device of claim 3 further comprising:

at least one sensor that provides at least one sensor signal that is responsive to the current operating conditions of the device to said controller.

5. The lean-to-steer device of claim 3 further comprising:

an operator interface that allows an operator to enter data that is used by said controller to adjust the angular position of said first wheel about the first steering axis in response to the at least one sensor signal.

6. The lean-to-steer device of claim 5 wherein said controller takes operator height data inputted via said operator interface into consideration when adjusting the angular position of said first wheel about the first steering axis.

7. The lean-to-steer device of claim 3 wherein said first wheel mounting structure mounts a supplementary first wheel that is axially aligned with said first wheel and rotates about the first wheel axis.

8. The lean-to-steer device of one of claim 3 further comprising:

means for adjusting the steering angle of said second wheel about a second steering axis that is parallel to and longitudinally spaced apart from the first steering axis, said means for adjusting the steering angle of the second wheel being operated by said controller in response to the at least one sensor signal.

9. The lean-to-steer device of claim 3 wherein said at least one sensor includes at least one accelerometer that is responsive to forces directed along the transverse axis.

10. The lean-to-steer device of claim 3 wherein said at least one sensor includes at least one sensor responsive to tilt of said body with respect to said first wheel axis, and at least one sensor responsive to travel speed of the device.

11. The lean-to-steer device of claim 10 wherein said at least one sensor includes a sensor responsive to change in direction of travel.

12. The lean-to-steer device of claim 3 wherein said at least one sensor includes at least one gyroscope.

13. The lean-to-steer device of claim 3 wherein said controller has a memory that stores at least a first steering response that provides a first response function of adjusting the angular position of said first wheel responsive to the at least one sensor signal and a second steering response that provides a second response function of adjusting the angular position of said first wheel responsive to the at least one sensor signal, wherein the determination of which steering routine to implement is made by a selection routine of said controller based on said at least one sensor signal, and wherein said second response function is different from said first response function.

14. The lean-to-steer device of claim 3 further comprising:

a drive motor operably coupled to drive at least one of said first wheel and said second wheel.

15. The lean-to-steer device of claim 3 wherein said steering actuator is operable to adjust the angular position of said first wheel about the first steering axis independently of the leaning action of the device.

16. A lean to steer device comprising:

a body with an upper support surface for supporting an operator, said body having a longitudinal axis and a transverse axis;

a first wheel rotatable about a first wheel axis;

a first wheel mounting structure that attaches said first wheel to said body while allowing said body to tilt about the longitudinal axis relative to said first wheel, said first wheel mounting structure being configured to allow said first wheel to pivot with respect to a first steering axis to alter the inclination of the first wheel axis relative to the longitudinal axis;

a steering actuator that is operable to adjust the angular position of said first wheel about the first steering axis;

a second wheel mounted with respect to said body so as to rotate about a second wheel axis that is displaced from said first wheel axis along the longitudinal axis; and a controller that receives signals responsive to the current operating conditions of the device from at least one sensor, said controller directing said steering actuator to adjust the angular position of said first wheel about the first steering axis in response to the at least one sensor signal, wherein said controller, in at least one mode of operation, adjusts the angular position of the first wheel about the first steering axis to cause the net lateral forces due to the mass of the operator to form a vector that is within 30° of a vector that intersects the longitudinal axis.

17. The lean-to-steer device of claim 16 further comprising:

at least one sensor that provides at least one sensor signal that is responsive to the current operating conditions of the device to said controller.

18. The lean-to-steer device of claim 16 further comprising:

an operator interface that allows an operator to enter data that is used by said controller to adjust the angular position of said first wheel about the first steering axis in response to the at least one sensor signal.

19. The lean-to-steer device of claim 16 wherein said first wheel mounting structure mounts a supplementary first wheel that is axially aligned with said first wheel and rotates about the first wheel axis.

20. The lean-to-steer device of one of claim 16 further comprising:

means for adjusting the steering angle of said second wheel about a second steering axis that is parallel to and longitudinally spaced apart from the first steering axis, said means for adjusting the steering angle of the second wheel being operated by said controller in response to the at least one sensor signal.

21. The lean-to-steer device of claim 16 wherein said controller has a memory that stores at least a first steering response that provides a first response function of adjusting the angular position of said first wheel responsive to the at least one sensor signal and a second steering response that provides a second response function of adjusting the angular position of said first wheel responsive to the at least one sensor signal, wherein the determination of which steering routine to implement is made by a selection routine of said controller based on said at least one sensor signal, and wherein said second response function is different from said first response function.

22. The lean-to-steer device of claim 16 wherein said steering actuator is operable to adjust the angular position of said first wheel about the first steering axis independently of the leaning action of the device.

* * * * *